US009385473B2

(12) United States Patent
Iwatani

(10) Patent No.: US 9,385,473 B2
(45) Date of Patent: Jul. 5, 2016

(54) LEVER-ACTUATED ELECTRICAL CONNECTOR AND MATING SYSTEM

(71) Applicant: Tyco Electronics Japan G.K., Kanagawa-ken (JP)

(72) Inventor: Shingo Iwatani, Kanagawa-ken (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 0 days.

(21) Appl. No.: 14/481,005

(22) Filed: Sep. 9, 2014

(65) Prior Publication Data

US 2015/0079830 A1 Mar. 19, 2015

(30) Foreign Application Priority Data

Sep. 9, 2013 (JP) ..... 2013-185946

(51) Int. Cl.
*H01R 13/641* (2006.01)
*H01R 13/629* (2006.01)

(52) U.S. Cl.
CPC ..... *H01R 13/62938* (2013.01); *H01R 13/6295* (2013.01); *H01R 13/641* (2013.01)

(58) Field of Classification Search
CPC ..... H01R 13/641; H01R 13/62938; H01R 13/6272; H01R 13/62955
See application file for complete search history.

(56) References Cited

U.S. PATENT DOCUMENTS 5,320,556 A * 6/1994 Otaka ..... H01R 13/641 439/372
5,672,068 A * 9/1997 Tsuchiya ..... H01R 13/62933 439/157
5,689,191 A * 11/1997 Kashiyama ..... H01R 43/22 324/538
5,701,079 A * 12/1997 Yagi ..... G01R 31/045 324/538
6,213,791 B1 4/2001 Kodama
6,319,050 B1 * 11/2001 Miyazaki ..... H01R 13/62938 439/157
6,361,356 B1 * 3/2002 Heberlein ..... H01R 13/62977 439/157

(Continued)

FOREIGN PATENT DOCUMENTS

JP 2008108467 A 5/2008
JP 2009117045 A 5/2009
JP 2012150959 A 8/2012

OTHER PUBLICATIONS

French Preliminary Report, dated Mar. 11, 2016, 2 pages.

*Primary Examiner* — Gary Paumen
(74) *Attorney, Agent, or Firm* — Barley Snyder

(57) ABSTRACT

A lever-actuated electrical connector is disclosed having a housing mateable with a mating connector having a complementary mating terminal. A mating lever is positioned on the housing and rotatable from an initial mating position to a final mating position. A lever lock is disposed on the mating lever and latches to a mating housing of the mating connector when the mating connector and electrical connector are completely mated. A mating detection terminal is positioned on the mating lever and forms a detection circuit when in contact with the mating terminal of the mating connector. The position of the mating detection terminal is controlled by the lever lock through the operation of the mating lever, and the detection circuit is only formed when the mating lever is in a final mating position.

14 Claims, 7 Drawing Sheets

(56) References Cited

U.S. PATENT DOCUMENTS 6,666,697 B2 * 12/2003 Yamashita ..... H01R 13/62977 439/152
6,705,881 B2 * 3/2004 Tsuchiya ..... H01R 13/62938 439/157
6,863,551 B2 * 3/2005 Fukamachi ..... H01R 13/64 439/157
8,113,871 B2 * 2/2012 Todo ..... H01R 13/62911 439/489
8,282,411 B2 * 10/2012 Itzenhuiser ..... H01R 13/62955 439/352
2002/0182928 A1 * 12/2002 Matsushita ..... H01R 13/6295 439/489
2003/0190836 A1 * 10/2003 Yamashita ..... H01R 13/62938 439/489
2007/0059968 A1 3/2007 Ohtaka et al.

* cited by examiner

LEVER-ACTUATED ELECTRICAL CONNECTOR AND MATING SYSTEM

CROSS-REFERENCE TO RELATED APPLICATIONS

This application claims the benefit of the filing date under 35 U.S.C. §119(a)-(d) of Japanese Patent Application No. 2013-185946, filed Sep. 9, 2013.

FIELD OF THE INVENTION

The present invention generally relates to a lever-actuated electrical connector, and more specifically a lever-actuated electrical connector having a mating detection circuit.

BACKGROUND

Certain electrical connectors ("connectors") have a large number of contacts depending on connector's application. To mate or disconnect these connectors from each other, a large force is required to overcome the friction generated by the contacts. Lever-actuated connectors are often used in these applications, where the mating and disconnecting of the connector from a mating connector is performed by using the mechanical advantages provided by leverage.

Conventionally, a lever is mounted on a plug housing of a lever-actuated connector, such as a connector housing a female terminal, so as to pivot between an initial mating position and a final mating position. A receptacle housing of a mating connector, such as a connector housing a male terminal, is provided with a cam pin. When the connector housing and receptacle housing are in initial contact with each other with the lever held in the initial mating position, the cam pin is advanced into a cam groove provided in the lever. The lever is then rotated to the final mating position, during which a cam action is produced between the cam groove and the cam pin with each other. The cam action causes both the housings to mate with each other, and the terminals of both the connectors are electrically connected together.

A term "pivot" (or "pivotable") as used herein indicates that both a clockwise swing and a counterclockwise swing are possible, and either a clockwise rotation or a counterclockwise rotation is simply referred to as rotation.

Since a lever-actuated connector impairs its function as a connector if used without completion of proper mating, it is necessary to make sure that the mating has been completed.

Various conventional mating detection methods are known, such as the one described in Japanese Patent Application No. 2012-150959 A, which provides a terminal to detect whether devices have been connected together.

Similarly, Japanese Patent Application No. 2009-117045 A discloses a lever-actuated connector having a terminal for mating detection. Prior to mating the mating detection terminal is separate from a counterpart mating detection terminal and after mating has been completed, the mating detection terminal is in contact with the counterpart mating detection terminal to form a detection circuit. The detection circuit electrically detects whether normal mating has been completed.

However, the connector disclosed in JP 2009-117045 A is provided with a detection arm displaced by the operation of a lever for mating, and the operation of the detection arm elastically deforms the mating detection terminal, thereby controlling contact and non-contact with the mating detection terminal of the mating connector. In addition, the lever is provided with a member necessary to operate the detection arm, such as a pressing portion and a preliminarily-pressing portion. Consequently, these conventional connectors use a large number of components that increase the complexity of the connector and results in undesirable increases in cost.

There is a need for a lever-actuated electrical connector with a reduced number of elements that is capable of achieving a mating detection function.

SUMMARY

It is therefore an object of the invention to disclose a lever-actuated electrical connector is having a housing mateable with a mating connector having a complementary mating terminal. A mating lever is positioned on the housing and rotatable from an initial mating position to a final mating position. A lever lock is disposed on the mating lever and latches to a mating housing of the mating connector when the mating connector and electrical connector are completely mated. A mating detection terminal is positioned on the mating lever and forms a detection circuit when in contact with the mating terminal of the mating connector. The position of the mating detection terminal is controlled by the lever lock through the operation of the mating lever, and the detection circuit is only formed when the mating lever is in a final mating position.

BRIEF DESCRIPTION OF THE DRAWINGS

The invention will now be described by way of example, with reference to the following Figures, of which:

FIG. 3A is a plan view of a connector assembly before operation of the lever;

FIG. 3B is a partial-sectional view of the connector assembly before operation of the lever, taken along line IIIb-IIIb in FIG. 3A;

FIG. 3C is a partial-sectional view of the connector assembly before operation of the lever, taken along line IIIc-IIIc in FIG. 3A;

FIGS. 7B-1 and 7B-2 show action of a cam contributing to mating of the connector assembly after the completion of the lever operation.

DETAILED DESCRIPTION

Figure 1A:
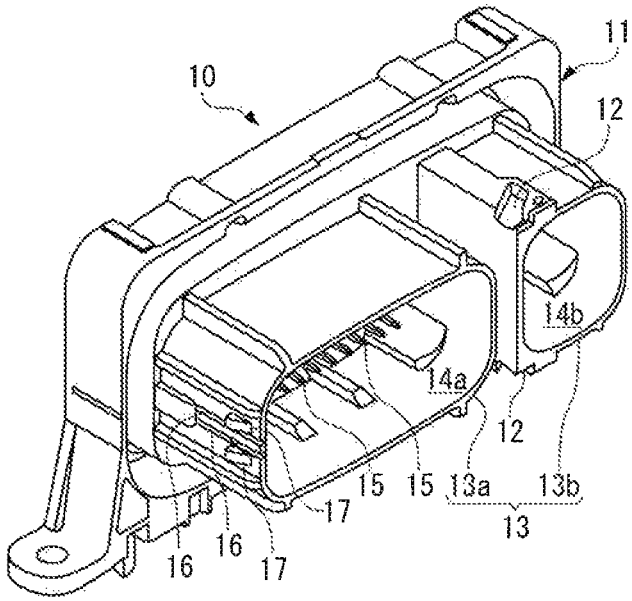
FIG. 1A is front perspective view showing a male connector.
Figure 1B:
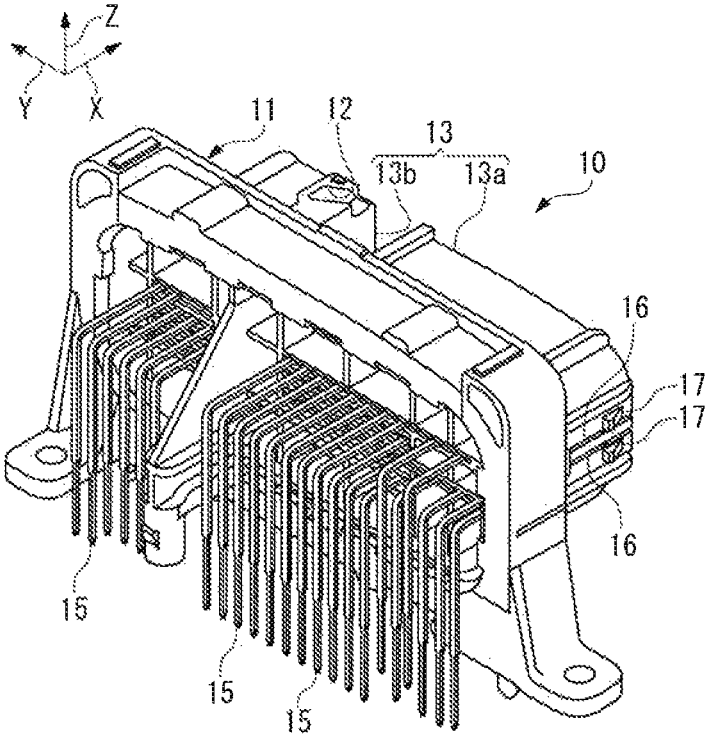
FIG. 1B is a rear perspective view showing the male connector.

An exemplary embodiment of an electrical connector includes a mating connector 10 and a connector 30. As a reference regarding the mating connector 10 and the connector 30, a side on which mating is performed is defined as a front side, and an opposite side as a rear side.

The mating connector 10 includes a mating housing 11, a mating hood 13 to be used for mating with the connector 30, a plurality of pin type signal terminals 15, and a pair of mating detection terminals 16 for detecting completion of proper mating of the mating connector 10 with the connector 30 (see FIGS. 4A-6B). The signal terminals 15 are held by the mating housing 11 in a press-fitting manner, a first portion of the signal terminal 15 is positioned inside the mating hood 13, and a second portion of the signal terminal 15 is disposed outside the mating housing 11.

The mating housing 11 is formed by injection molding of insulating resin. A housing 31 and a mating lever 50 of the connector 30 are formed in the same manner. The signal terminals 15 and the mating detection terminals 16 are formed from a metal material having excellent conductivity and elasticity, such as a copper alloy.

In an exemplary embodiment, the mating housing 11 includes two mating hoods 13 (13*a*, 13*b*) arranged side by side in a width direction X, and the mating hoods 13*a*, 13*b* are mated as one with the connector 30. The mating hoods 13*a*, 13*b* have receiving chambers 14*a*, 14*b* into which members of the connector 30 are inserted. For reference purposes, the two mating hoods 13*a*, 13*b* are collectively referred to as the mating hood 13, and the two receiving chambers 14*a*, 14*b* are collectively referred to as the receiving chamber 14.

The pair of mating detection terminals 16 are press-fitted to the mating housing 11 and held by the mating housing 11, and are arranged parallel to each other in a height direction Z with a space therebetween at one end in the width direction X of the mating housing 11. A first portion of each mating detection terminal 16 extending forward from a fixed portion held by the mating housing 11 is disposed along a side face of the mating hood 13*a*. A second portion of each mating detection terminal 16 extending backward from the fixed portion projects out of the mating housing 11. A distal end of the second portion is connected to a device for detection. The pair of mating detection terminals 16 are not electrically connected until a mating detection terminal 40 of the connector 30 comes into contact with the mating detection terminals 16, but when the mating detection terminal 40 comes into contact with both the two mating detection terminals 16, the mating detection terminal 40 and the mating detection terminals 16 function as a detection circuit.

The mating housing 11 is provided with a pair of locking projections 17 between which the pair of mating detection terminals 16 are disposed. The locking projections 17 latch with locking projections 55*b* of the mating lever 50, thereby preventing the mating connector 10 and the connector 30 from disconnecting from each other.

The mating housing 11 further includes cam grooves 12 in the mating hood 13*b*. The cam grooves 12 are positioned in upper and lower corners of the mating hood 13*b* facing the mating hood 13*a*.

When the connector 30 is mated with the mating connector 10, the mating lever 50 is engaged with the mating hood 13*b* by inserting cam pins 51*b* provided on the mating lever 50 into the cam grooves 12. Then, by rotating the mating lever 50 in a predetermined direction, the cam pins 51*b* are urged within the cam grooves 12, thereby producing a leverage effect.

The connector 30 is mated with the mating connector 10 through the mating hood 13, and includes a plurality of socket-like terminals ("female terminals" (not shown)) to be connected to the plurality of signal terminals 15 to transmit a signal. The connector 30 is a lever-actuated electrical connector provided with the housing 31 holding the plurality of female terminals. A mating lever 50 is pivotally mounted on the housing 31 and used when the connector 30 is mated with the mating connector 10.

The connector 30 is provided with two portions, a first mating portion 31*a* and a second mating portion 31*b*, corresponding to the two mating hoods 13*a*, 13*b* of the mating connector 10.

The mating lever 50 is pivotally mounted on the housing 31, and functions as a leverage mechanism by being operated when the connector 30 is mated with or unmated from the mating connecter 10.

Figure 6A:
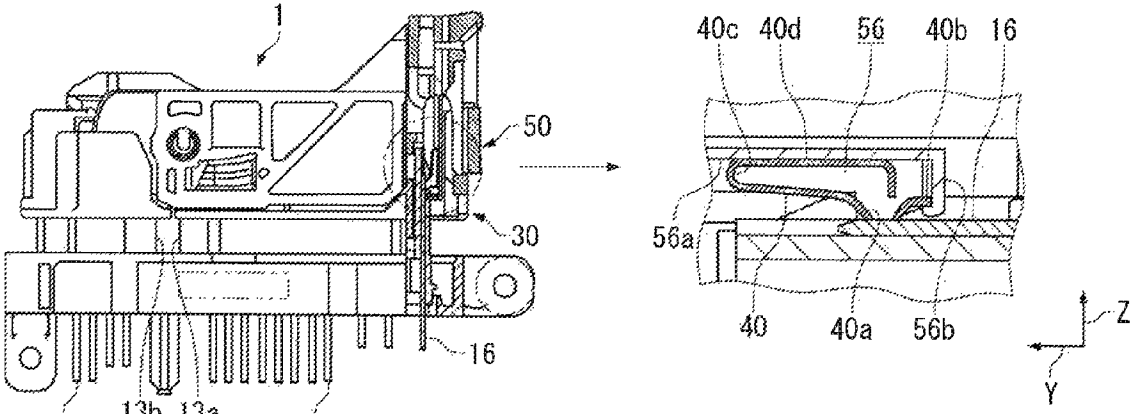
FIG. 6A is a partial-sectional view of a portion of the connector assembly where the lever is in a final position compared to FIG. 3B.
Figure 6B:
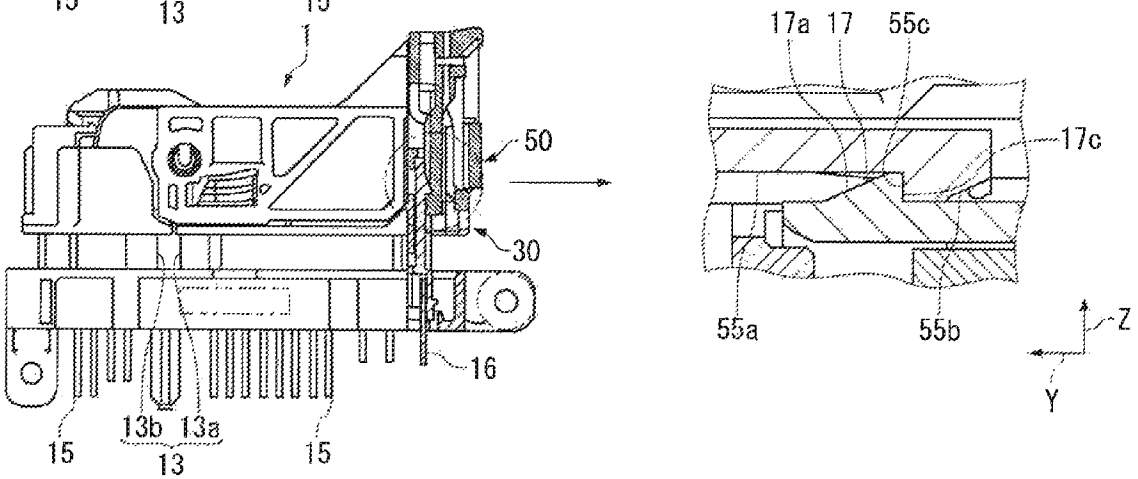
FIG. 6B is a partial-sectional view of a portion of the connector assembly where the lever is in a position compared to FIG. 3C.
Figures 1, 7A:
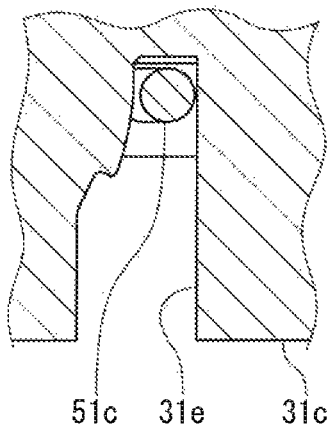
FIGS. 7A-1 and 7A-2 show actions of a cam contributing to mating of the connector assembly before the lever operation.
Figures 2, 7A:
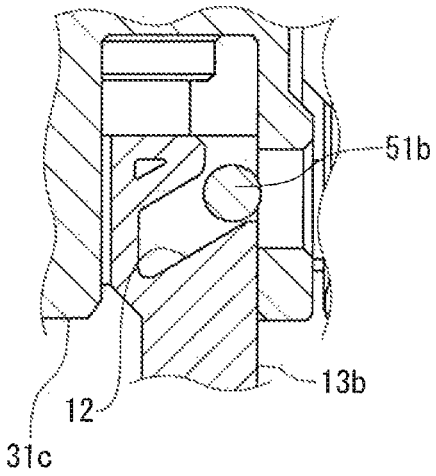
Figures 1, 7B:
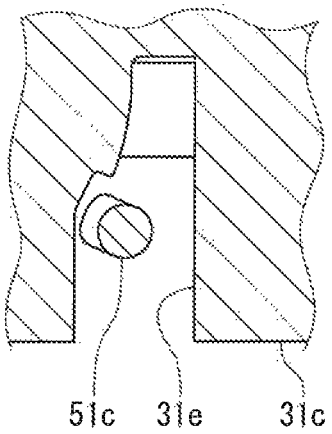
Figures 2, 7B:
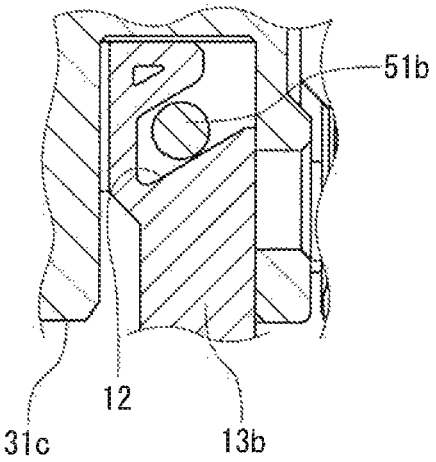

The mating lever 50 is pivoted between a initial mating position shown in FIGS. 2A-3C and a final mating position shown in FIGS. 6A and 6B. The connector 30 is properly mated with the mating connector 10 when the mating lever 50 is rotated clockwise from the initial mating position to the final mating position, while the connector 30 and the mating connector can be unmated when the mating lever 50, in the properly-mated state, is rotated counterclockwise from the final mating position to the initial mating position.

Figure 2A:
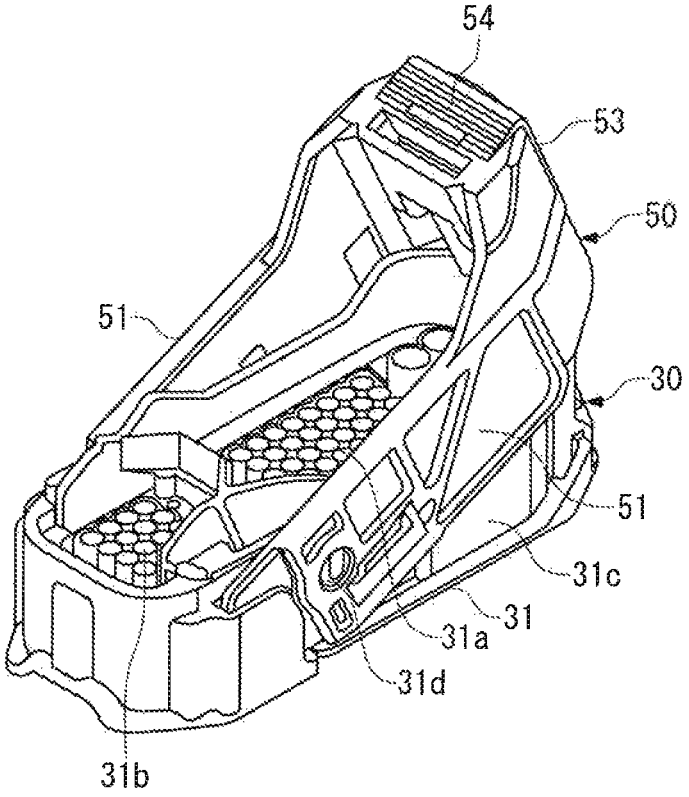
FIG. 2A is a rear perspective view of a female connector viewed from a rear side.
Figure 2B:
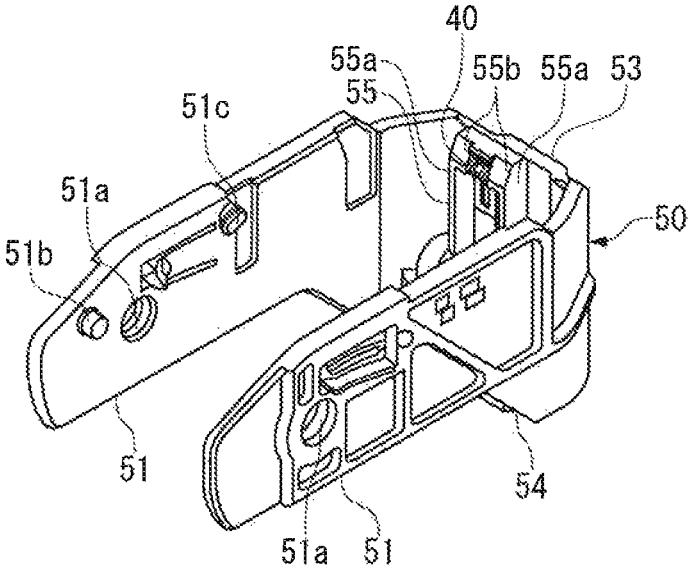
FIG. 2B is a perspective view of the female connector showing a lever of the female connector.

The mating lever 50, as shown in FIGS. 2A and 2B, has a pair of cam plates 51 and an operating rod 53. The operating rod 53 joins distal ends of the pair of cam plates 51 together, and has a gate shape.

A shaft receiving hole 51*a*, into which a supporting shaft 31*d* formed integrally on a side walls 31*c* of the housing 31 is inserted, penetrates through both the front and rear surfaces of each cam plate 51. The mating lever 50 is supported on the housing 31 and is capable of pivoting about the supporting shafts 31*d*.

Each cam plate 51 has a cam pin 51*c* positioned on a side facing the housing 31, as shown in FIGS. 7A-1-7B-2. The camp pin 51*c* is inserted into a cam groove 31*e* formed in the side wall 31*c* of the housing 31, Each cam plate 51 also has the cam pin 51*b* positioned on an inner surface. The cam pin 51*b* is provided on opposite side of the shaft receiving hole 51*a* (supporting shaft 31*d*) with respect to the cam pin 51*b*.

The cam pin 51*b* is inserted into the cam groove 12 of the mating housing 11, and the cam pin 51*c* is inserted into the cam groove of the housing 31. In addition, the cam plate 51 (mating lever 50) has its center of rotation at the shaft receiving hole 51*a* (supporting shaft 31*d*) between the cam pin 51*b* and the cam pin 51*c*. Therefore, once the operating rod 53 is operated in a mating direction, the cam pin 51*b* moves along the cam groove 12 into a deeper side of the cam groove 12, thereby providing the supporting shaft 31*d* with force pressing the housing 31 into the mating connector 10, and thus the mating is achieved.

The operating rod 53, as shown in FIGS. 2A and 2B, has an operating portion 54 and an acting portion 55.

When the connector 30 is mated with the mating connector 10, a user pushes the operating portion 54 to rotate the mating lever 50. The operating portion 54 is positioned on a rear side in a direction in which the mating lever 50 rotates upon mating.

The acting portion 55 has a pair of lever locks 55*a* that latch onto the locking projections 17, 17 of the mating connector 10 to block the mating lever 50 from rotating in an unmating direction when the mating lever 50 is in the final mating position. The respective lever locks 55*a* have a space in the width direction X, and a pair of locking projections 55*b* on a front end in the rotating direction upon mating. When the mating lever 50 is in the final mating position, the locking projections 55*b* are latched directly on the locking projections 17.

Once the mating lever 50 reaches the final mating position, as shown in FIG. 6B, a latching face 55*c* of the locking projection 55*b* faces a latching face 17*c* of the locking projection 17.

The acting portion 55 includes a mating detection terminal 40 to be electrically connected with the mating detection terminals 16 of the mating connector 10 once the mating lever 50 reaches the final mating position, as shown in FIG. 6B. The mating detection terminal 40 is positioned between the pair of lever locks 55*a* and held in a mating detection terminal chamber 56. The mating detection terminal chamber 56 is open on an inner peripheral side of the operating rod 53, and a portion of the mating detection terminal 40 is exposed to the outside.

The mating detection terminal chamber 56 is defined widthwise by the lever lock 55*a*. The mating detection terminal chamber 56 includes an upper wall 56*a* defining a radial direction and a retaining wall 56*b* defining a front side in the rotating direction upon mating.

The mating detection terminal 40, as shown in FIG. 6A, is provided with a folded portion 40*c* bent in a U shape at a longitudinal substantially-central portion of the mating detection terminal 40, a contact portion 40*a* provided on one side continuous from the folded portion 40*c*, and a catching portion 40*b* provided in front of the contact portion 40*a*. The contact portion 40*a* is a region projecting upward and coming into direct contact with the mating detection terminal 16 of the mating connector 10. The mating detection terminal 40 is also provided with a supporting portion 40*d* on the other side continuous from the folded portion 40*c*. The one side of the mating detection terminal 40 is bifurcated from the folded portion 40*c*, and the contact portion 40*a* and the catching portion 40*b* are provided in each of the bifurcated portions.

The supporting portion 40*d* on the other side of the mating detection terminal 40 is supported on the upper wall 56*a* inside the mating detection terminal chamber 56. The catching portion 40*b* of the mating detection terminal 40 is positioned on the retaining wall 56*b*. When the connector 30 is mated with the mating connector 10, the locking projections 55*b* ride onto the locking projections 17 of the mating connector 10, causing the folded portion 40*c* to elastically deform and to displace the contact portion 40*a* upward. The contact portion 40*a* in this position does not interfere with the mating detection terminal 16 in a height direction Z. Once the load from the mating lever 50 is removed, the contact portion 40*a* elastically returns to its initial position.

The process in which the mating detection terminals 16 and the mating detection terminal 40 come into contact with each other when the connector 30 is mated with the mating connector 10 will be described with reference to FIGS. 3A-6B.

Figure 3A:
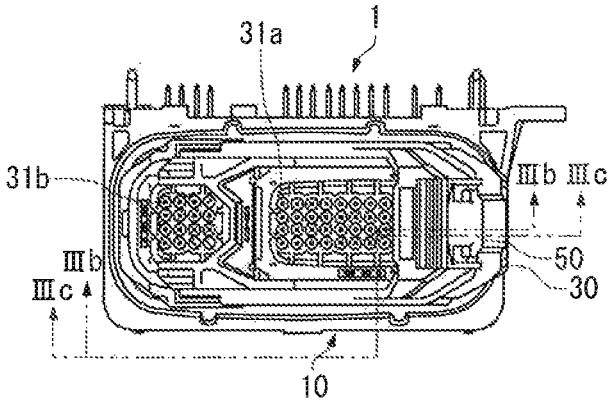
FIGS. 3A, 3B, and 3C show a connector assembly according to the embodiment before operation of the lever.
Figure 3B:
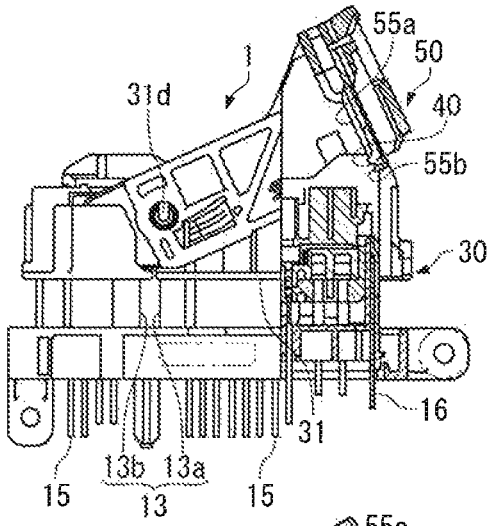
Figure 3C:
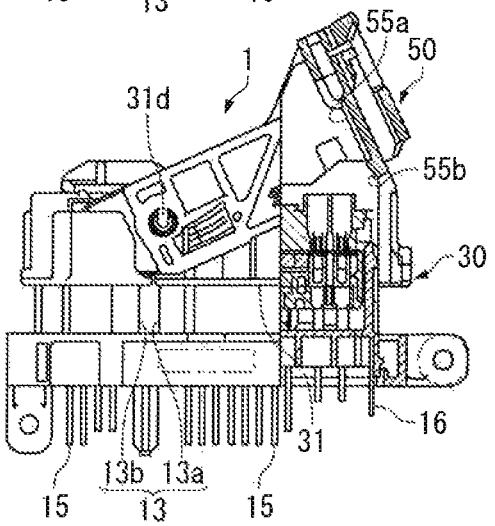
Figure 4A:
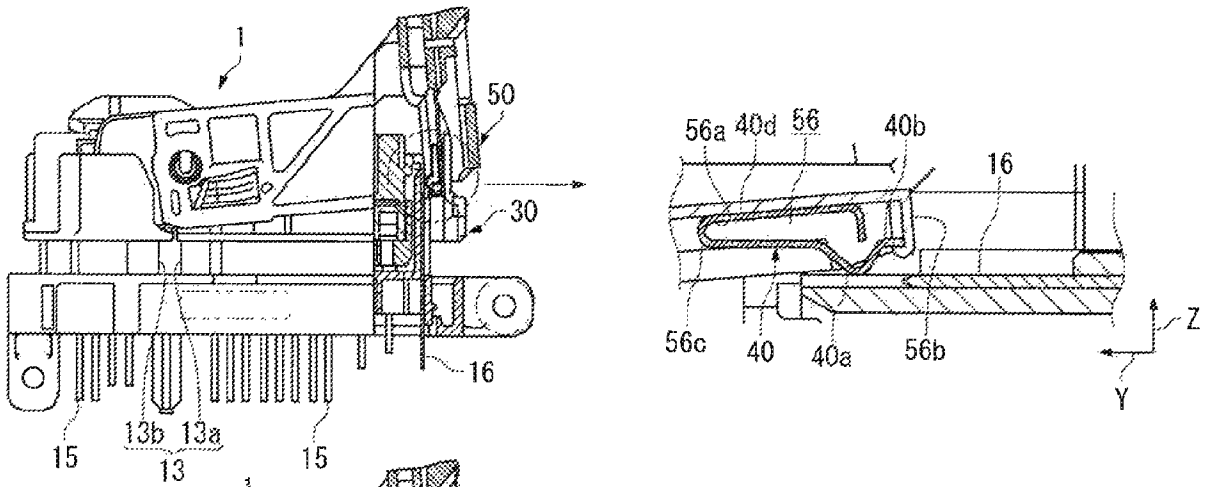
FIG. 4A is a partial-sectional view of a portion of the connector assembly where the lever is in operation from a position corresponding to FIG. 3B.
Figure 4B:
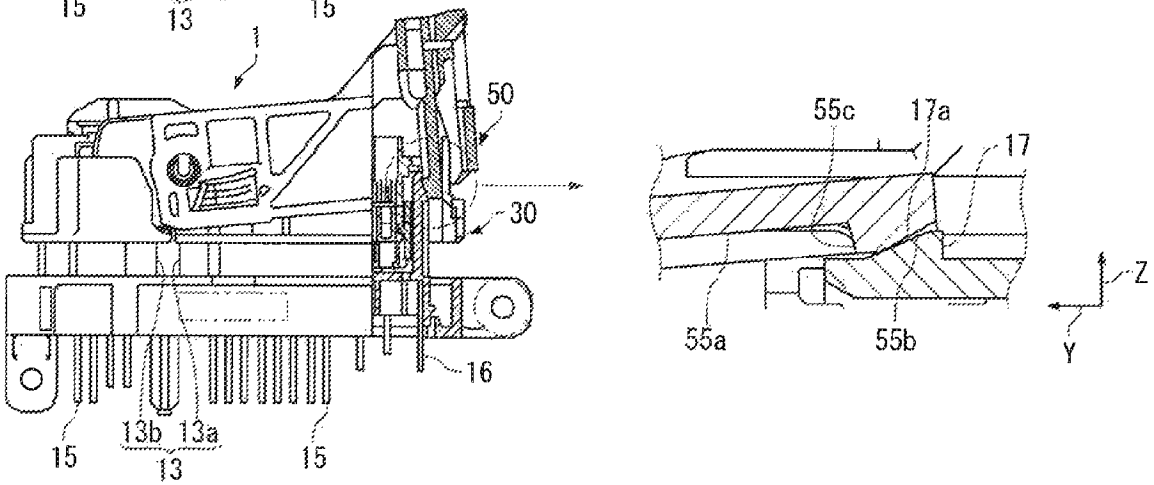
FIG. 4B is a partial-sectional view of a portion of the connector assembly where the lever is in operation from the position corresponding to FIG. 3C.
Figure 5A:
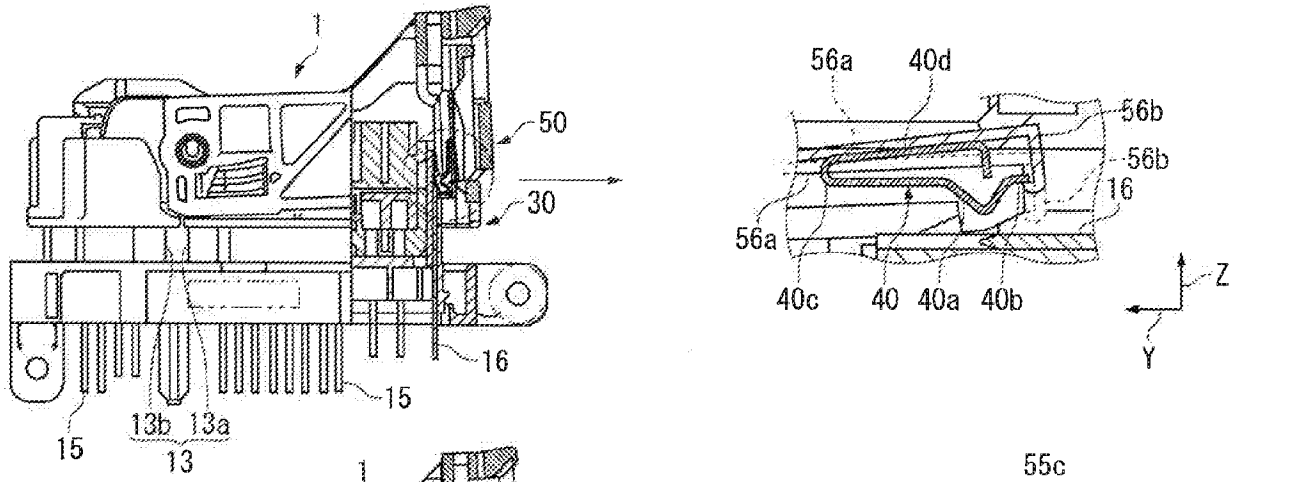
FIG. 5A is a partial-sectional view of a portion of the connector assembly where the lever is in operation from a position corresponding to FIG. 3B.
Figure 5B:
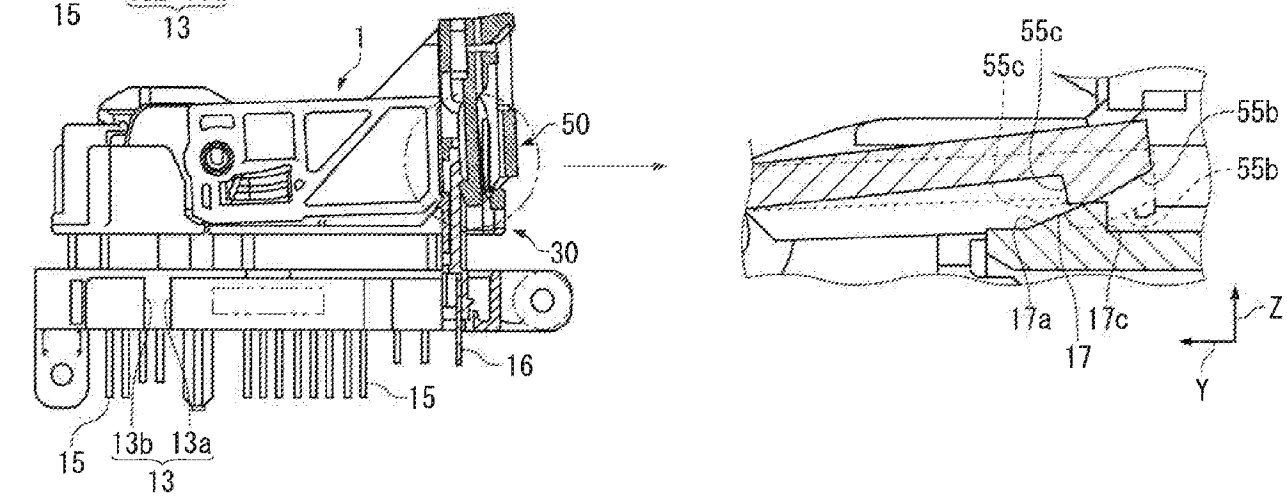
FIG. 5B is a partial-sectional view of a portion of the connector assembly where the lever is in operation from a position corresponding to FIG. 3C.

Before the mating operation is started, the connector 30 is positioned and inserted into the mating hood 13 of the mating connector 10. Prior to the mating operation, when the connector's 30 insertion depth is shallow, as shown in FIG. 3A-3C, the mating lever 50 is separated from the lever locks 55*a*, and the lever locks 55*a* and the mating detection terminal 40 are in their initial positions.

The connector 30 is then pushed into the mating connector 10 until the cam pins 51*b* and the cam pins 51*c* are inserted into the respective corresponding cam grooves, and then the mating lever 50 is rotated. In the embodiment shown in FIGS. 3(*a*)-6(*b*), the mating lever 50 is rotated clockwise.

When the mating lever 50 is rotated, the cam pins 51*b* move along the cam grooves 12 into the deeper side of the cam grooves 12, thereby causing the supporting shafts 31*d* to push the housing 31 toward the final mating position on a deep side of the mating hood 13 of the mating connector 10. See FIG. 7A-1. The mating detection terminal 40 is activated through the actions of the lever locks 55*a* following the operation of the mating lever 50.

The lock projections 55*b* of the lever locks 55*a* are pushed upward while sliding on guide faces 17*a* of the lock projections 17. See FIGS. 4A-5B. Following upward displacement of the locking projections 55*b*, the retaining wall 56*b* and catching portion 40*b* are displaced upward, resulting in the contact portion 40*a* of the mating detection terminal 40 also being displaced upward. Before the final mating position is reached, the contact portion 40*a* of the mating detection terminal 40 reaches a position in which the contact portion 40*a* can interfere with the mating detection terminal 16 in a front-back direction Y. See FIGS. 5A and 5B. However, since the distal end of the contact portion 40*a* is pushed down to a position higher than the mating detection terminals 16, the mating detection terminals 16 and the mating detection terminal 40 are not electrically connected.

When the mating lever 50 is rotated until the locking projections 55*b* of the lever locks 55*a* ride over the locking projections 17 of the mating connector 10, the mating lever 50 reaches the final mating position shown in FIGS. 6A and 6B. Then, the connector 30 moves to the deepest side of the mating hood 13 of the mating connector 10, and the mating of the mating connector 10 and the connector 10 is completed.

The lever locks 55*a* elastically return to the initial positions and, accordingly, the mating detection terminal 40 also elastically returns toward the initial position, and the contact portion 40*a* comes into contact with the mating detection terminals 16. A detection circuit is formed by the mating detection terminal 16 and the mating detection terminal 40 in this manner, so the completion of proper mating of the mating connector 10 and the connector 30 can be verified.

Further, since the locking projections 55*b* and the locking projections 17 are latched to each other, the rotation of the mating lever 50 in the unmating direction is restricted.

As described above, in the electrical connector assembly 1, the mating detection terminal 40 provided in the connector 30 does not come into contact with the mating detection terminals 16 of the mating connector 10 in the course of mating from the start of mating the connector 30 with the mating connector 10 before the final mating position is reached. However, the mating detection terminal 40 does contact the mating detection terminals 16 when the final mating position has been reached. Therefore, according to the present invention, if the user stops operating the mating lever 50 in the course of the mating, an electrical conduction is not detected, alerting the user of an incomplete mating. However, when the mating is complete, the electrical connection is detected alerting the user of the completion of the mating.

The connector 30 uses the lever lock 55*a* latching to the mating lever 55 to actuate the mating detection terminal 40. Since the mating lever 50 and the lever locks 55*a* are members necessary for the lever-actuated electrical connector, and the connector 30 uses these members to cause the mating detection terminal 40 to act, it is unnecessary to provide a special member to actuate the mating detection terminal 40. Therefore, according to the connector 30, a lever-actuated electrical connector having a mating detection function is achieved using a minimal number of parts.

While exemplary embodiments of the present invention have been described above, one of ordinary skill in the art would recognize that any of the structures described in the above embodiments can be selected or changed to another structure as appropriate without departing from the essence of the present invention.

The structures of the mating connector 10 and the connector 30 are merely exemplary embodiments and not limiting. For example, the number of mating hoods is not limited to two and may be any number, including one or three or more. The mating detection terminal 40 also may have any structure as long as the mating detection terminal 40 constitutes a detection circuit in combination with the mating detection terminals 16 of the mating connector 10, and can take necessary actions in the course of the mating.

What is claimed is:

1. A lever-actuated electrical connector comprising:

a housing mateable with a mating connector having a complementary mating terminal;

a mating lever positioned on the housing and rotatable from an initial mating position to a final mating position;

a lever lock disposed on the mating lever that latches to a mating housing of the mating connector when the mating connector and electrical connector are completely mated; and a mating detection terminal positioned on the mating lever and forming a detection circuit when in direct contact with the mating terminal of the mating connector when the mating lever is in the final mating position, the position of the mating detection terminal being controlled by the lever lock through the operation of the mating lever.

2. The lever-actuated connector according to claim 1, wherein the mating detection terminal makes contact with the mating terminal or separates from the mating terminal through the lock lever, following the operation of the mating lever from the initial mating position to the final mating position.

3. The lever-actuated connector according to claim 1 wherein the mating lever comprises a pair of cam plates pivotably supported on the housing.

4. The lever-actuated connector according to claim 3, wherein the mating lever further comprises an operating rod joining the pair of cam plates.

5. The lever-actuated connector according to claim 4, wherein the lever lock is displaced following movement of the operating rod.

6. The lever-actuated connector according to claim 5, wherein the operating rod moves when the mating lever is rotated.

7. A mating system comprising:

a mating connector having a counterpart mating terminal; and an electrical connector having a mating lever, a lever lock that locks the mating lever in a final mating position when the electrical connector is completely mated with the mating connector, and a mating detection terminal forming a detection circuit when in direct contact with the mating terminal.

8. The mating system of claim 7, wherein the mating detection terminal is brought into contact with the mating terminal through movement of the lever lock.

9. The mating system of claim 8, wherein the lever lock is displaced through an operation of the mating lever.

10. The mating system of claim 9, wherein the mating detection terminal contacts the mating terminal only when the mating lever is in the final mating position.

11. The mating system of claim 7, wherein the mating connector further comprises a mating housing having at least one cam groove.

12. The mating system of claim 11, wherein the electrical connector further comprises at least one cam pin positioned on the mating lever.

13. The mating system of claim 12, wherein when the mating connector is mated with the electrical connector, the cam pin is inserted into the cam groove.

14. The mating system of claim 13, wherein the rotation of the mating lever urges the cam pin along the cam groove, producing a leverage effect.

* * * * *